US007699119B1

(12) United States Patent
Lunde et al.

(10) Patent No.: US 7,699,119 B1
(45) Date of Patent: Apr. 20, 2010

(54) AUGER QUICK COUPLER

(76) Inventors: James Lunde, 205 Blanding Woods Rd., St. Croix Falls, WI (US) 54024; John G. Schwartz, 2105 English St., Maplewood, MN (US) 55109

( * ) Notice: Subject to any disclaimer, the term of this patent is extended or adjusted under 35 U.S.C. 154(b) by 648 days.

(21) Appl. No.: 11/509,276

(22) Filed: Aug. 24, 2006

Related U.S. Application Data

(60) Provisional application No. 60/711,616, filed on Aug. 26, 2005.

(51) Int. Cl.
*E21B 10/44* (2006.01)

(52) U.S. Cl. ..... 175/18; 175/323; 175/394; 403/292; 403/294; 403/296; 403/301

(58) Field of Classification Search ..... 403/292, 403/293, 294, 296, 301, 306; 175/18, 323, 175/394
See application file for complete search history.

(56) References Cited

U.S. PATENT DOCUMENTS 2,447,956 A * 8/1948 Morders ..... 403/305
3,104,757 A * 9/1963 Dougherty et al. ..... 403/292
3,178,210 A * 4/1965 Dickinson ..... 403/292
5,431,507 A * 7/1995 Smilanick ..... 403/307
5,940,933 A * 8/1999 Chang ..... 16/439
5,967,693 A * 10/1999 Braaten et al. ..... 403/292
6,151,810 A * 11/2000 Mukai ..... 37/350

* cited by examiner

*Primary Examiner*—Michael P Ferguson
(74) *Attorney, Agent, or Firm*—D L Tschida

(57) ABSTRACT

A coupler for securing an auger and/or extension piece(s) to a PTO shaft. In one construction, a threaded PTO collar mounts to a PTO shaft and mates with a suitable length stub shaft and captured, knurled hand nut mounted to an auger. The stub shaft indexes in non-rotational engagement to the PTO collar. In another construction, a PTO collar provides several detents that interconnect with resiliently biased projections at an auger collar. A hand piece maintains the connection. In other embodiments, key(s) at the PTO shaft mate in non-rotational engagement with keyway(s) at an auger and a resilient member latches the non-rotational connection. Shaped PTO shaft surfaces and complementary auger coupler surfaces can be included with the later couplers to enhance the connection.

6 Claims, 8 Drawing Sheets

AUGER QUICK COUPLER

RELATED APPLICATION DATA

This is a non-provisional of provisional application Ser. No. 60/711,616, filed Aug. 26, 2005.

BACKGROUND OF THE INVENTION

The present invention relates to couplers and, in particular, to a coupler for connecting the shaft of an auger (e.g. an ice or earth drilling auger) to a powerhead.

A variety of types of augers, including spiral fluted augers are used in many different applications. Some applications use a horizontally positioned auger to convey materials. Some applications use a vertical auger for boring holes in soil or ice, such as during winter sport fishing.

The latter ice augers are typically sold in standard lengths and are fastened to the power take-off shaft (PTO) of a power head that includes a gasoline engine and reduction gear assembly. The auger typically includes a cylindrical head coupler having a transverse hole that mounts in telescoping relation to the PTO shaft. A threaded bolt is passed through aligned holes in the head coupler and PTO and fastened to secure the auger to the power head. Extensions shafts can be added in a similar fashion upon aligning and fitting threaded or pin fasteners to holes at the auger and any extension(s).

The length of the resulting power head and auger/extension assembly can present an inconvenience when transporting or storing the assembly. It is therefore desirable to break the assembly down for transport or storage, but which is time consuming and difficult under cold weather conditions, such as when ice fishing.

The present coupler was developed to provide a mechanism for readily dismantling an auger and/or extension piece(s) from a power head. The auger, power head and extension pieces can then be easily stored and reassembled when next needed. In one construction, the coupler comprises a threaded collar that is adapted to mount to a PTO shaft. A mating stub shaft of suitable length and captured, knurled hand nut or collar separately mounts to an auger head coupler. The stub shaft indexes in non-rotational engagement with the PTO collar and the captured threaded hand nut draws the auger and power head together.

In another construction, a non-rotationally mounted PTO collar provides several detents that interconnect with resiliently biased projections (e.g. balls) at an auger collar.

Attachment of the auger is effected by releasing tension of the projections (e.g. pulling or rotating the collar to release tension on the balls), slipping the auger collar over the power head collar and engaging the projections with the detents.

In yet other embodiments, the PTO shaft can include a key (e.g. pin or spline key) that mates with a keyway at an auger head coupler. The auger coupler can include means for resiliently biasing the auger coupler or PTO shaft to latch the key in non-rotational engagement with a provided keyway (e.g. slot, groove or channel). The PTO shaft may also include a surface shaped to non-rotationally interlock with a surface of the auger. A resiliently biased latch means maintains the interlocked condition, when attached, and flexes under certain conditions to release the auger.

SUMMARY OF THE INVENTION

It is accordingly a primary object of the invention to provide a quick release assembly for non-rotationally coupling a power head to an auger.

It is a further object of the invention to provide a quick release assembly comprising mating threaded collar pieces and a captured stub shaft of suitable length that respectively mount to a PTO shaft and an auger.

It is a further object of the invention to provide a quick release assembly comprising collar pieces with mating detents and resiliently biased projections and a captured stub shaft that respectively mount to a PTO shaft and an auger.

It is a further object of the invention to provide a quick release assembly comprising a mating key and keyway and a means for resiliently interlocking the key with the keyway to secure a PTO shaft to an auger.

The foregoing objects, advantages and distinctions of the invention are obtained in several alternative constructions of the invention. In one construction, a threaded member mounts to a PTO shaft. A mating stub shaft of suitable length includes a shaped end surface that mounts in non-rotational engagement with the PTO member and separately mounts to an auger coupler head. An intermediate knurled hand nut or collar captured on the stub shaft mounts to the threaded PTO member and draws one to the other upon tightening. In another construction, a PTO collar provides several detents that non-rotationally interconnect with resiliently biased projections at a moveable collar to the auger coupler.

In yet other embodiments, a PTO shaft includes a key that mates with a keyway at an auger and means for resiliently biasing the key to latch in non-rotational engagement with the auger keyway. The PTO shaft may also include a surface shaped to non-rotationally interlock with a surface of the auger coupler and a resiliently biased, detachable auger latch means to facilitate auger detachment yet maintain an interlocked condition, when attached.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

Figure 1:
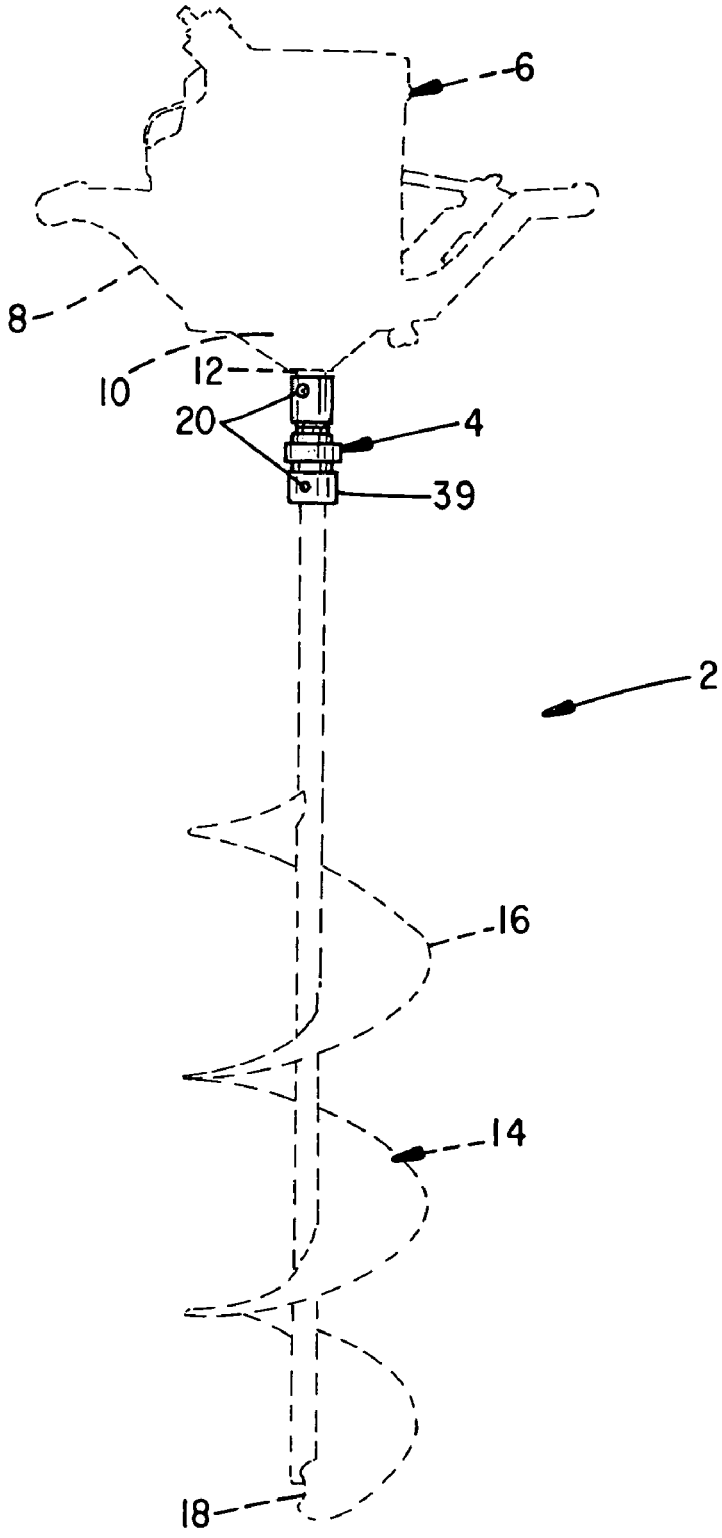
FIG. 1 is a perspective drawing to an ice auger wherein the PTO output shaft is coupled to the shaft of a spiral auger.

Similar structure throughout the drawings is referred to with the same alphanumeric reference numerals and/or characters.

DESCRIPTION OF THE PREFERRED EMBODIMENT

Referring to FIG. 1, a perspective view is shown to an ice auger 2 that has been improved with one of several alternative constructions of detachable couplers 4 of the invention. The auger 2 includes a power head 6 that typically includes a gasoline engine 8 and a reduction gear assembly 10 from which a power-takeoff shaft (PTO) 12 extends.

An auger 14 of suitable length and having suitable spiral fluting 16 and a cutting edge piece 18 couples to the power head 6. Depending upon the application and whether soil, sand, ice or other materials are being penetrated, the auger 14 can be configured in a variety of forms. When configured for ice fishing the auger 14 is approximately 40-48" long and is sized to drill a hole in the range of 6-10 inches diameter with one or more suitable cutters 18.

The auger 14 typically mounts to the PTO shaft 12 with a threaded bolt 20 that fastens through a hole 22 at an auger head or drive coupler or PTO collar 24. The auger 14 can be detached from the power head 6 upon using appropriate tools (e.g. an allen wrench), but which is somewhat time consuming. The disassembly process can also difficult or cumbersome when attempted under cold weather conditions and/or the bolt can be lost if dropped into snow, slush or the water at an ice hole. The coupler 4 of the invention and various alternative embodiments shown in FIGS. 2 through 7 accommodate a hand assembly/disassembly process. The ice fisherman is thereby able to readily dismantle and efficiently store an auger for travel and hand assemble the auger 2 without the need for extraneous tools.

Figure 2:
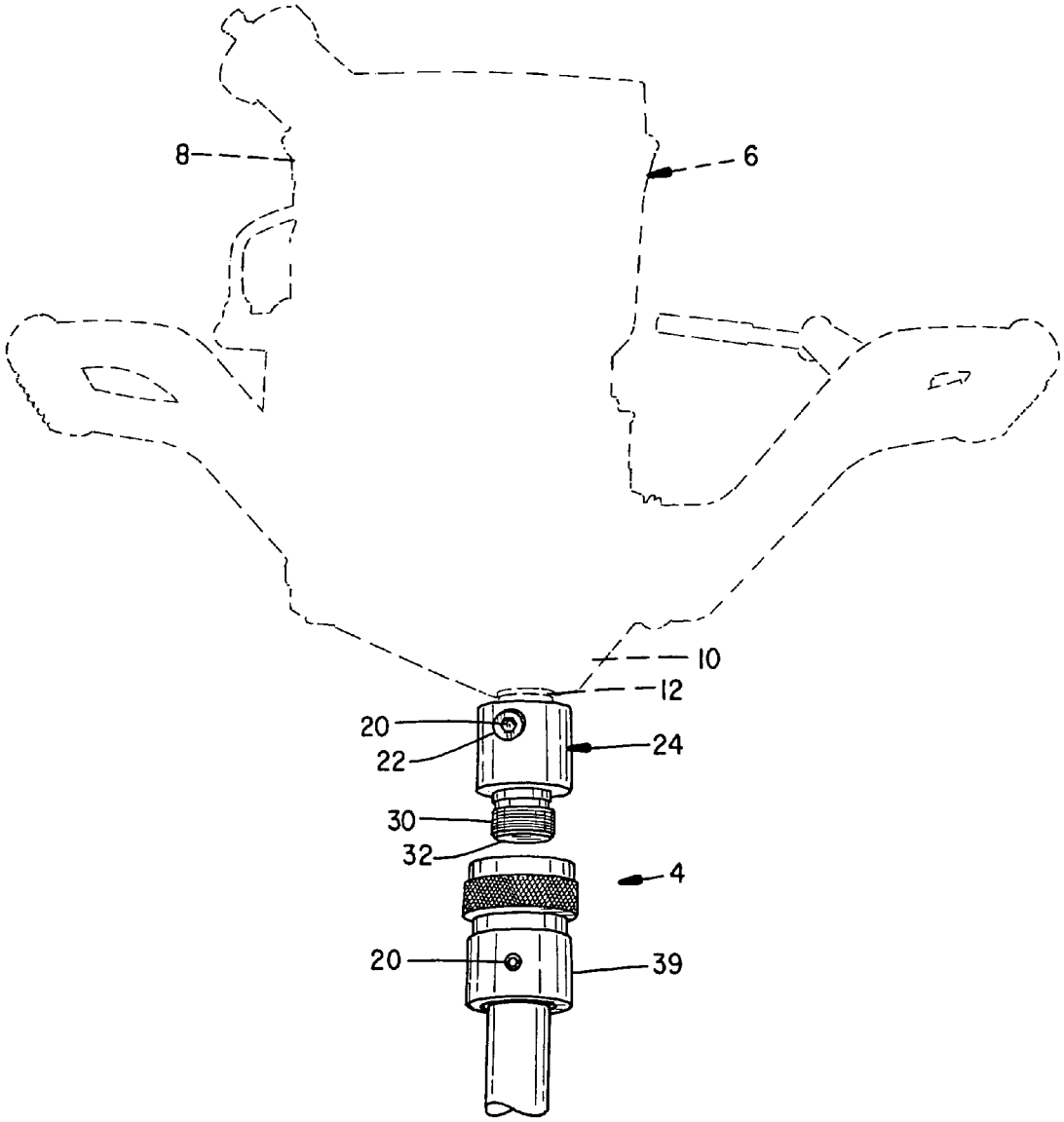
FIG. 2 is an enlarge drawing shown in exploded assembly to the quick coupler.
Figure 3:
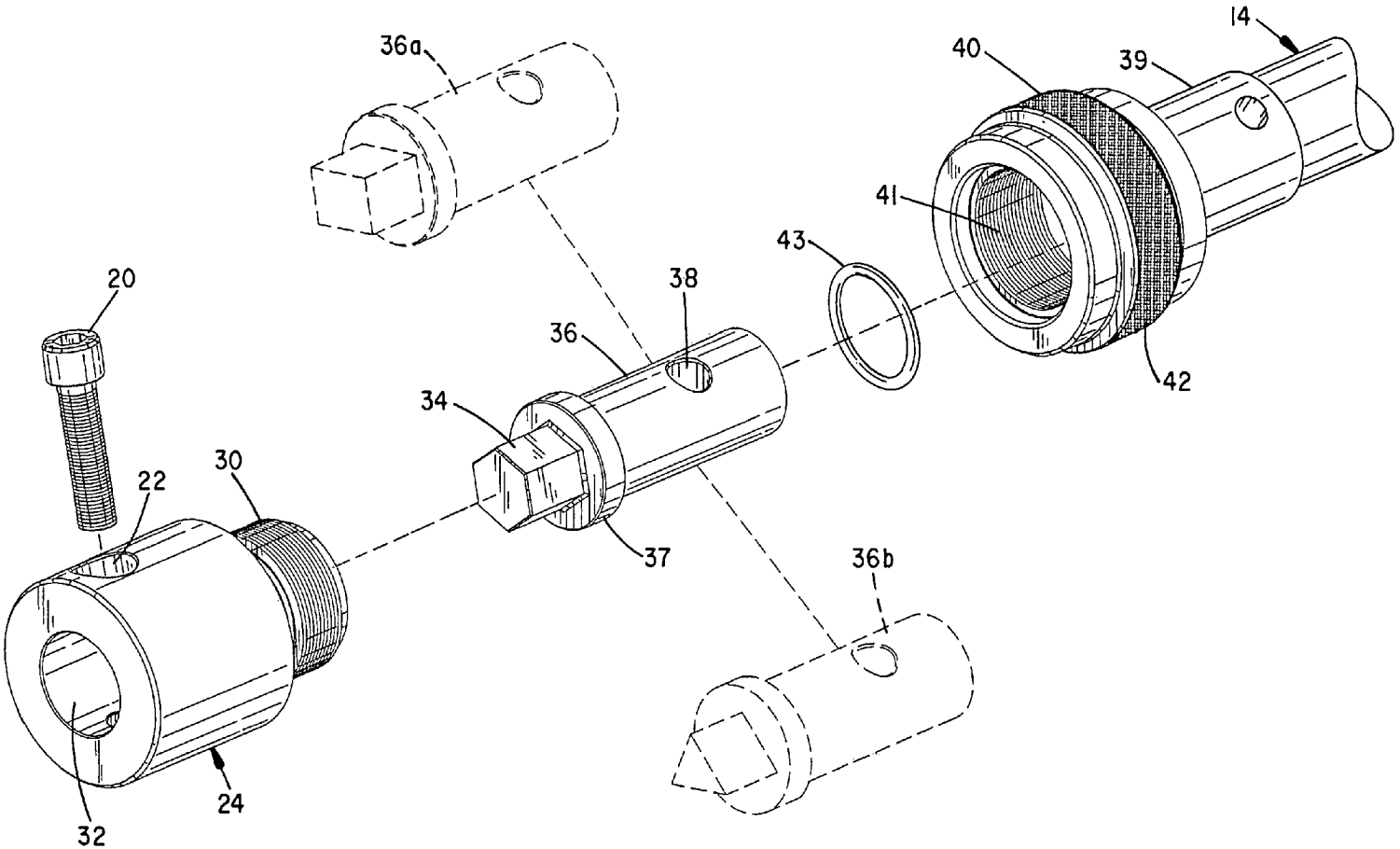
FIG. 3 is a perspective drawing shown in exploded assembly to a threaded coupler assembly for attaching a power head to an auger and wherein alternative output shaft extensions are shown in dashed line.
Figure 4:
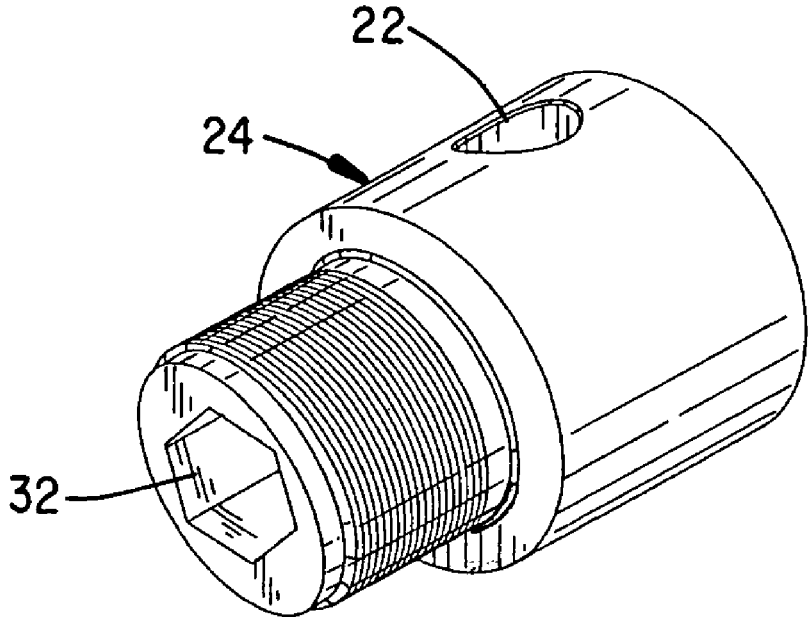
FIG. 4 is a perspective end view to a PTO shaft fitting piece.

Turning attention to FIGS. 2 and 3 and the construction of the coupler 4, the threaded PTO collar 24 is formed and adapted to mount to the PTO shaft 12. The shouldered hole 22 in the PTO collar 24 is formed to align with a mating hole in the PTO shaft 12 and the threaded fastener 20 is mounted to the aligned holes to retain the collar 24 to the PTO shaft 12. A threaded surface 30 at one end of the PTO collar 24 is formed around a longitudinal bore 32 having an indexable internal shape (e.g. hexagon (⅞" diameter with ⅝" hex pilot drive), square, triangular, pyramidal etc.), reference FIG. 4.

The bore 32 mates with a pilot or end fitting 34 of a stub shaft 36. The stub shaft 36 can be cut to any desired length (e.g. 4, 6, 12, 18-inches) and the end fitting 34 can take alternative shapes as shown in the alternative stub shafts 36*a* and 36*b* shown in dashed line. The length of the stub can be judiciously sized to accommodate different thicknesses of ice. Upon mounting the fitting 34 within the bore 32, the stub shaft 36 is indexed and captured in non-rotational alignment with the PTO shaft 12 and power head 6.

A hole 38 aligns with a hole 22 in the auger 14 end coupler 39 and a fastener 20 secures the stub shaft 36 to the auger 14. Captured in concentric relation to the stub shaft 36 via a flange 37 is a knurled auger hand nut or collar 40. A threaded bore surface 41 mates with the surface 30 to draw and retain the auger 14 to the power head 6. Knurling 42 or another roughened surface treatment at the collar 40 facilitates hand manipulation of the collar 40. An o-ring seal 43 is interposed between the PTO and auger collars 24 and 40 to minimize possible release of the collar 40 from vibration etc.

Figure 5:
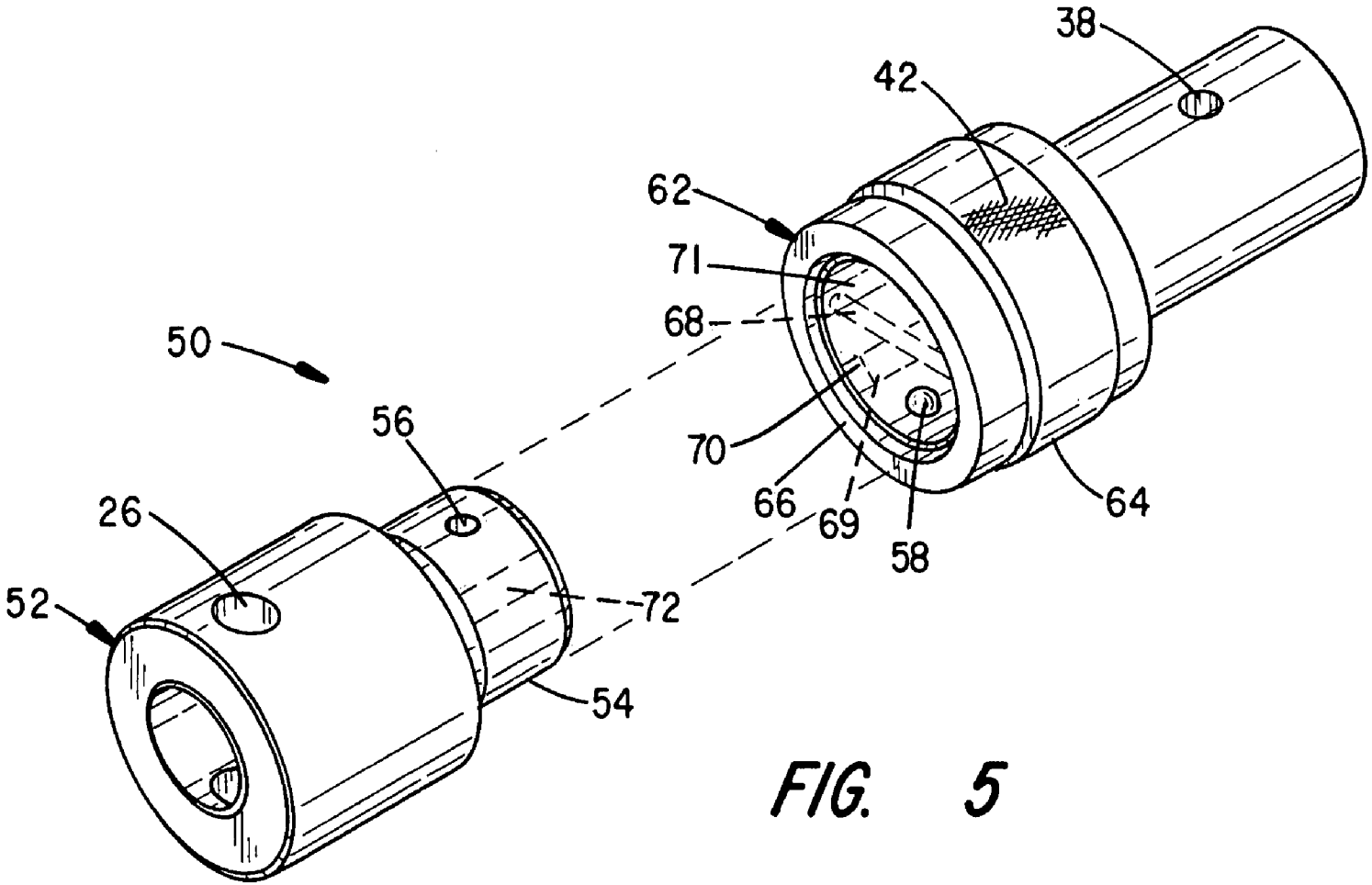
FIG. 5 is a perspective drawing shown in exploded assembly to a coupler having a PTO shaft piece with detents and an auger collar piece with resiliently biased mating projections at an auger that non-rotationally engages the PTO shaft piece.

With attention to FIG. 5, another two-piece coupler 50 is shown. The coupler 50 provides a PTO shaft collar 52 that mounts as before to a PTO shaft via a hole 26 and fastener 20. An end surface 54 includes a number of detents 56 that are shaped and arranged to mate with a number of projections 58 (e.g. balls, pin ends etc.) that resiliently and selectively project from a bore 60 of an auger collar 62. The projections 58 are resiliently restrained beneath a knurled hand sleeve 64 fitted to a body 66 of the collar 62. The sleeve 64 can be spring biased and mounted to slide and/or rotate along spiraled grooving (not shown) at the collar 62, such as in the fashion for example of pneumatic and hydraulic quick connect couplers.

A distal end of the body 66 includes a hole 38 that mounts to an auger end coupler 39. Upon respectively fitting the collars 52 and 62 to the PTO shaft 12 and auger 14, a non-rotational coupling is achieved by merely retracting the sleeve 64 and coupling the projections 58 in alignment with the detents 56. Upon release of the sleeve 64, operating stresses of the auger are spread over the several projections/detents 58/56.

Operating stress at the projections/detents 58/56 can be reduced by including a cross pin 68 or spline 70 (shown in dashed line) at the collar bore 71 and mating slots 72 (shown in dashed line) at the collar 52. Alternatively, the surface 54 can be formed for example with flat sides (e.g. square, hexagon, elliptical, triangular) to index or key in complementary fashion to the bore 70 in the fashion of the surface 32 and pilot end 34 at the stub shaft, thereby providing a non-rotational, hand operated coupling between the power head 6 and auger 14.

Figure 6:
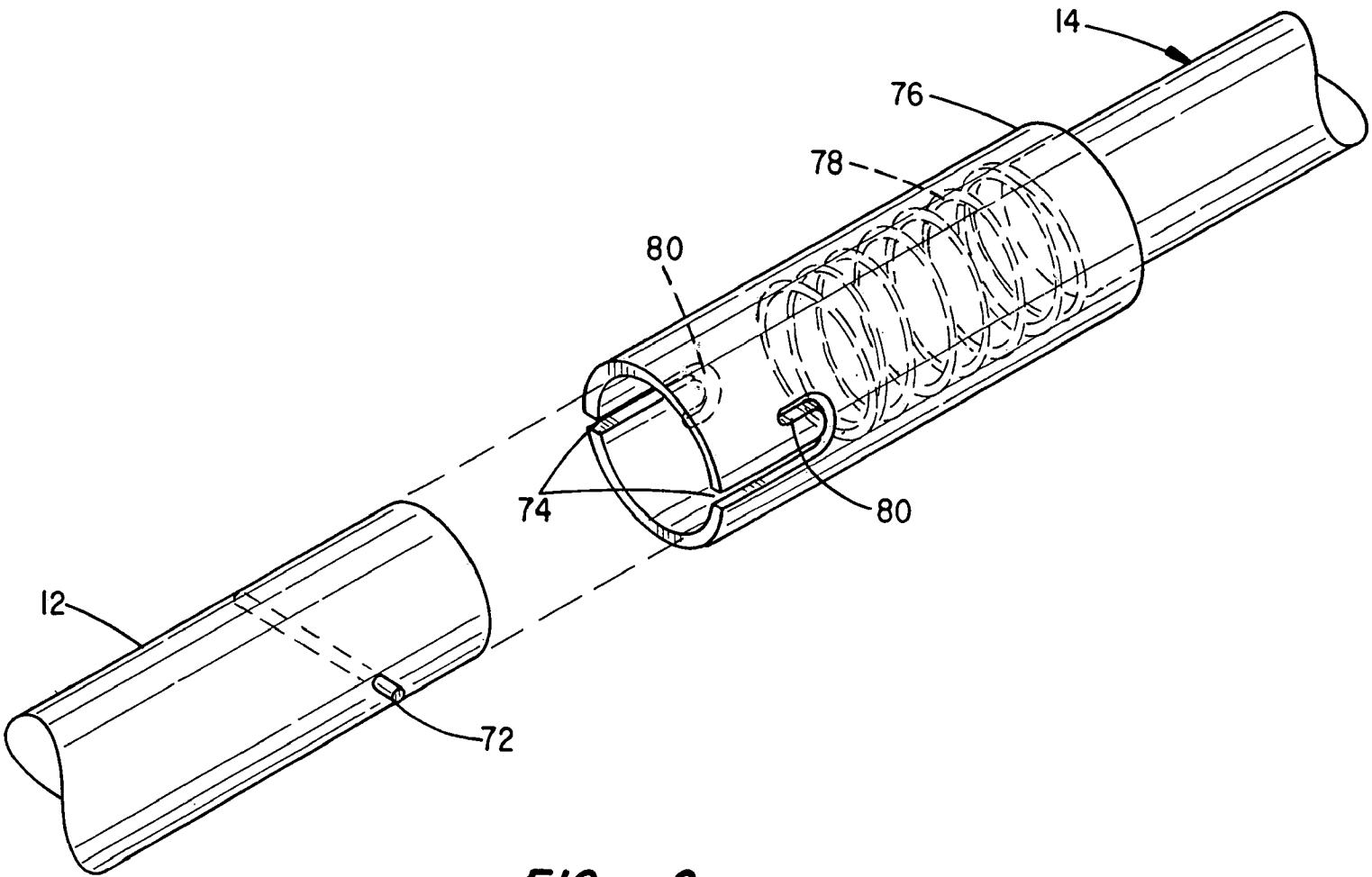
FIG. 6 is a perspective drawing showing a keyed PTO shaft and auger head with a mating coupler and keyway and means for resiliently maintaining an interconnection between the key and keyway.
Figure 7:
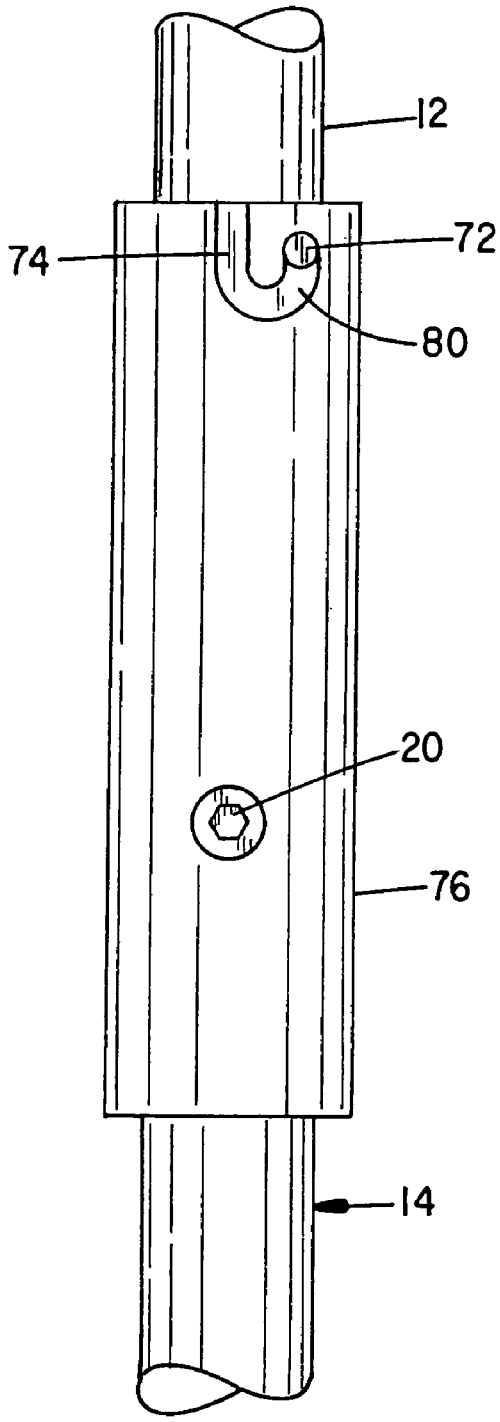
FIG. 7 is a plan drawing showing the keyed PTO shaft and a detachable auger head coupler with the pin retainer mounted in the keyway.
Figure 8:
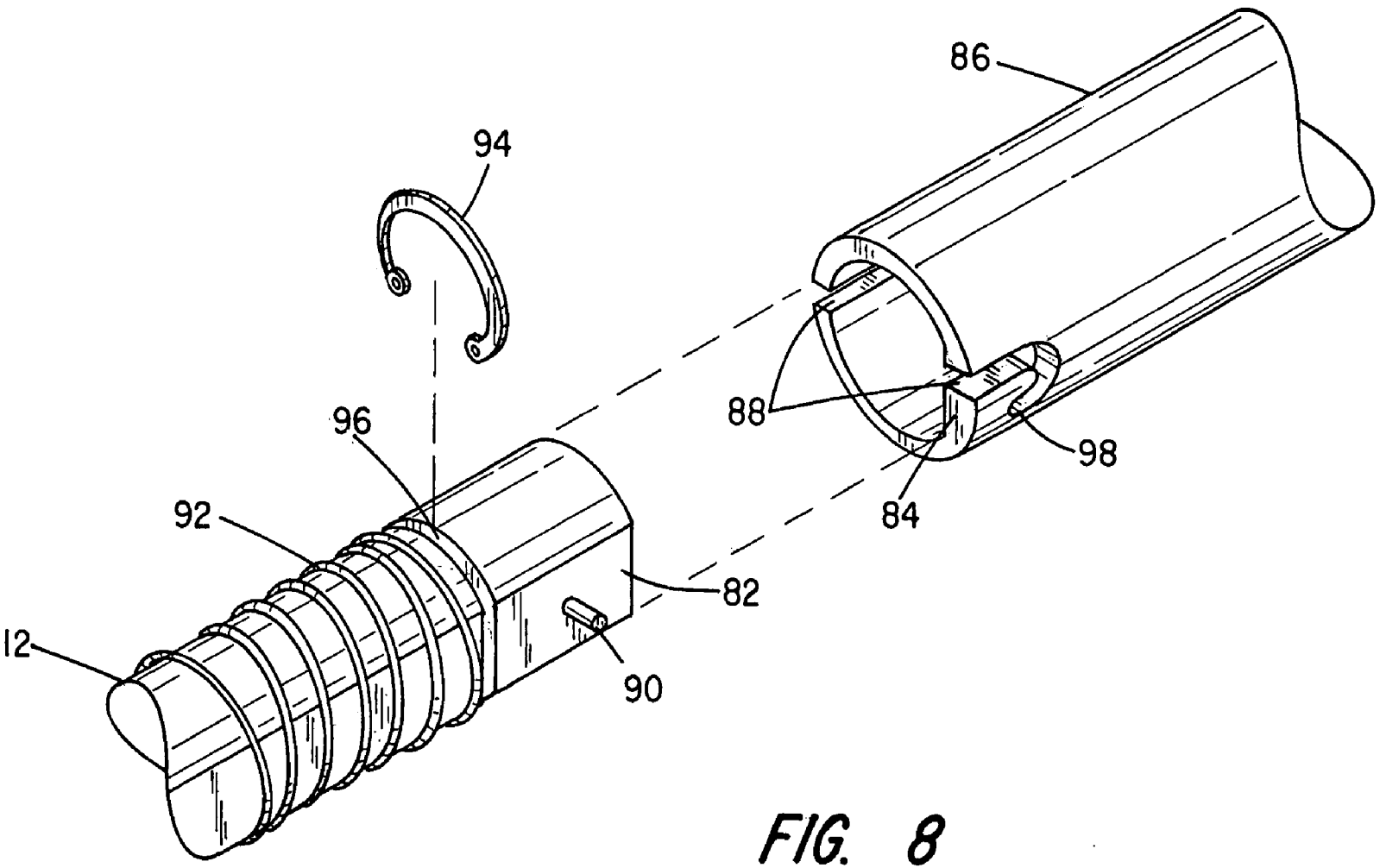
FIG. 8 is a perspective drawing showing an alternative PTO shaft and auger coupler having non-rotational mating surfaces and a spring captured to the PTO shaft to resiliently bias an interconnection between the PTO shaft and auger.

Still other alternative embodiments are shown at FIGS. 6, 7 and 8. FIG. 6 depicts a PTO shaft 12 that includes a cross pin 72. The ends of the pin 72 mate with keyways 74 let into an auger head coupler 76. A spring 78 is secured in the coupler 76 and abuts the shaft 12.

Upon aligning the pin 72 with the keyways 74, pushing and rotating the PTO shaft 12 and pin 72, the spring 78 induces the pin 72 to nest in the offset vertical keyway space or slot portion 80 which secures the auger 14 in non-rotational engagement to the PTO shaft 12. Appreciating normal clockwise rotation of the PTO shaft 12, the keyway 74 is oriented to resist possible unintended release of the shaft 12 during normal use of the auger assembly 2. FIG. 8 depicts the pin 72 as it appears when nested into the slot portion 80.

With attention to FIG. 8, the PTO shaft 12 may include a flat surface 82 or other suitable shaped surface to non-rotationally interlock with a complementary flat surface 84 at an auger head coupler 86. The auger head coupler 86 also includes a pair of keyways 88. A cross pin 90 is also mounted to extend through the sides of the PTO shaft 12. A spring 92 is secured to the PTO shaft 12 with a snap ring 94 fitted to a groove 96 let into the shaft 12. Upon sliding the ends of the pin 94 along the keyways 96 and rotating the pin ends 90 to mount in the lateral slots 98, the spring 88 resiliently biases the connection to maintain an interlocked coupling between the power head and auger 14. If the pin ends 90 are depressed during normal use, rotation is maintained via the flats 82,84 and pin ends 90 and the pin ends 90 return to the slots 98 due to the spring bias with termination of drilling.

While the invention has been described with respect to a number of preferred constructions and considered improvements or alternatives thereto, still other constructions may be suggested to those skilled in the art. It is to be appreciated that selected ones of the foregoing features can also be used singularly or can be arranged in different combinations to provide a variety of improved, hand manipulated, detachable to power head to auger or extension piece couplings. The couplers can also be adapted to other types of shafts that require changing. The foregoing description should therefore be construed to include all those embodiments within the spirit and scope of the following claims.

What is claimed is:

1. An auger assembly comprising:

a) a motor driven shaft having a transverse bore;

b) a tubular drive coupler piece having a longitudinal bore, a transverse bore through a sidewall of the drive coupler piece communicating with said longitudinal bore, and a threaded surface exposed at one end, wherein the longitudinal bore of the drive coupler piece in the region of the threaded surface exhibits a flat bore surface and wherein the longitudinal bore of the drive coupler piece is mounted to said driven shaft and a first fastener mounted through the transverse bores of said driven shaft and said drive coupler piece secures the drive coupler piece to the driven shaft;

c) an auger containing spiral fluting that radially projects from a central auger shaft and having an auger coupler end having a longitudinal bore and a transverse bore through a sidewall of the auger coupler end communicating with said longitudinal bore of the auger coupler end;

d) an elongated stub shaft having at one end an end fitting with a flat sidewall surface mounted to mate with the flat bore surface of the drive coupler piece and including a flange surface that radially projects from a sidewall of said stub shaft and a transverse bore that extends through the sidewall of said stub shaft, wherein the transverse bore of the stub shaft is supported in the longitudinal bore of the auger coupler end, and wherein a second fastener mounted through the transverse bores of the stub shaft and auger coupler end secures the stub shaft to the auger coupler; and e) a tubular collar piece rotatably connected to and displaceable along said auger coupler end and having a bore exhibiting a threaded surface and wherein the collar piece draws the flange surface and the auger to the drive coupler upon interconnecting the flat surfaces of the stub shaft and drive coupler piece and the threaded surfaces of said collar piece and the drive coupler piece to secure the auger to the driven shaft.

2. An assembly as set forth in claim 1 wherein said collar piece includes an outer surface adapted to facilitate hand gripping and rotation.

3. An assembly as set forth in claim 1 including an o-ring seal mounted to said stub shaft between the collar piece and the drive coupler piece to prevent the release of the collar piece due to vibration.

4. An assembly as set forth in claim 1 wherein the flat bore surface region of the longitudinal bore of said drive coupler piece and the end fitting of said stub shaft comprise hexagonal cross-sections.

5. An auger assembly comprising:

a) an auger containing spiral fluting that radially projects from a central auger shaft and having an auger coupler end having a longitudinal bore and a transverse bore through a sidewall of the auger coupler end communicating with said longitudinal bore;

b) an elongated stub an end fitting with a hexagonal cross-section defining flat sidewall surfaces a hexagonal surface at one end and including a flange surface that radially projects from a sidewall of said stub shaft and a transverse bore that extends through the side wall of said stub shaft, wherein the transverse bore of the stub shaft is mounted in the longitudinal bore of the auger coupler end, and wherein a fastener mounted through the transverse bores of the stub shaft and auger coupler end secures the stub shaft to the auger;

c) a drive coupler piece having a longitudinal bore and for receiving a motor driven shaft and a transverse bore though a sidewall of the drive coupler piece communicating with said longitudinal bore for receiving a fastener for securing the drive coupler piece to the driven shaft and a threaded surface at one end and wherein the longitudinal bore exhibits a hexagonal cross-section defining flat bore surfaces; and d) an annular collar piece rotatably connected to and displaceable along said auger coupler end and having a bore exhibiting a threaded surface and wherein the collar piece draws the flange surface and the auger to the drive coupler piece upon interconnecting the flat surfaces of the stub shaft and drive coupler piece and the threaded surfaces of said collar piece and the drive coupler piece; and e) an o-ring seal mounted between said drive coupler piece and the collar piece to prevent the release of one from the other due to vibration.

6. An auger assembly comprising:

a) an auger containing spiral fluting that radially projects from a central auger shaft having an auger coupler end having a longitudinal bore and a transverse bore through a sidewall of the auger coupler end communicating with said longitudinal bore;

b) an elongated stub shaft having an end fitting having a hexagonal cross-section defining flat sidewall surfaces at one end, a cylindrical surface at an opposite end, a flange surface that radially projects from a sidewall of said stub shaft and a transverse bore that extends through said cylindrical surface, wherein said cylindrical surface is mounted in the longitudinal bore of the auger, and wherein a fastener mounted through the transverse bores of the stub shaft and auger coupler end secures the stub shaft to the auger;

c) a drive coupler piece having a longitudinal bore for receiving a motor driven shaft, a transverse bore though a sidewall of the drive coupler piece that communicates with the longitudinal bore for receiving a fastener for securing the drive coupler piece to the driven shaft and an external threaded surface at one end and wherein the longitudinal bore exhibits a hexagonal cross-section defining flat bore surfaces; and d) an annular collar piece exhibiting a surface formed to facilitate hand gripping and rotation and having a bore having a threaded surface, wherein the collar piece is rotatably connected to and displaceable along said auger coupler end, and wherein the collar piece draws the flange surface to the drive coupler piece upon interconnecting the flat sidewall surfaces of the stub shaft with the flat bore surfaces of the drive coupler and interconnecting the threaded surface of the collar piece with the threaded surface of said drive coupler piece to secure the auger to the stub shaft.

* * * * *

UNITED STATES PATENT AND TRADEMARK OFFICE

CERTIFICATE OF CORRECTION

PATENT NO. : 7,699,119 B1
APPLICATION NO. : 11/509276
DATED : April 20, 2010
INVENTOR(S) : James Lunde et al.

It is certified that error appears in the above-identified patent and that said Letters Patent is hereby corrected as shown below:

Column 5, line 63, after "an elongated stub" insert -- shaft having --

Column 6, line 9, after "a longitudinal bore" delete "and"

Column 6, line 45, replace "though" with -- through --

Signed and Sealed this

Eighth Day of June, 2010

David J. Kappos

David J. Kappos
*Director of the United States Patent and Trademark Office*